US010702978B2

(12) United States Patent
Meehan

(10) Patent No.: US 10,702,978 B2
(45) Date of Patent: Jul. 7, 2020

(54) SPIRAL RATCHET DRIVER WITH A CRANK AND SLIDER MECHANISM

(71) Applicant: Larry J. Meehan, Morgan Hill, CA (US)

(72) Inventor: Larry J. Meehan, Morgan Hill, CA (US)

( * ) Notice: Subject to any disclaimer, the term of this patent is extended or adjusted under 35 U.S.C. 154(b) by 197 days.

(21) Appl. No.: 16/043,379

(22) Filed: Jul. 24, 2018

(65) Prior Publication Data

US 2020/0030948 A1 Jan. 30, 2020

(51) Int. Cl.

| | |
|---|---|
| ***B25B 15/06*** | (2006.01) |
| ***B25G 1/00*** | (2006.01) |
| ***B25B 15/04*** | (2006.01) |

(52) U.S. Cl.

CPC ..... *B25B 15/06* (2013.01); *B25B 15/04* (2013.01); *B25G 1/007* (2013.01)

(58) Field of Classification Search

CPC ..... B25B 15/06; B25B 15/04; B25G 1/007
See application file for complete search history.

(56) References Cited

U.S. PATENT DOCUMENTS

| | | | | |
|---|---|---|---|---|
| 1,377,028 A | | 5/1921 | Poole | |
| 3,209,802 A | | 10/1965 | Human | |
| 4,524,650 A | | 6/1985 | Marks | |
| 4,739,838 A | | 4/1988 | Marks | |
| 5,893,305 A | | 4/1999 | Liao | |
| 5,911,722 A | * | 6/1999 | Adler | A61B 17/1624 174/170 |
| 7,946,198 B2 | * | 5/2011 | Gui | B25B 15/04 74/127 |

* cited by examiner

*Primary Examiner* — David B. Thomas

(57) ABSTRACT

A spiral ratchet driver with crank and slider mechanism comprises a spiral ratchet driver having a shank housing, a journal having a hole, connected to the shank housing by a screw, a ratchet mechanism assembly connected adjacent to the journal, a shank received in the shank housing and the ratchet mechanism assembly, a spindle having a spindle bearing connecting the second end of the shank to a chuck or a square drive, a lever connecting bar connected to the hole of the journal by means of a first rivet, a lever having a lever handle cushion grip, rotatably connected with the lever connecting bar, a handle bar having a handle bar grip on a free end, connected with the lever below the handle grip and connected with the spindle from a fixed end, a journal housing covering the journal, is connected with the handle bar and four or more bearing slides disposed between journal and the journal housing.

14 Claims, 8 Drawing Sheets

Section A-A

Section B-B

SPIRAL RATCHET DRIVER WITH A CRANK AND SLIDER MECHANISM

FIELD OF THE INVENTION

Embodiments of the present invention relate to hand tools and more particularly to a spiral ratchet driver with a crank and slider mechanism.

BACKGROUND ART

Drivers and screw drivers have been known in the art for some time now. They are available for both low-torque and high-torque applications. Low torque variety may be used for machine screws and high torque variety may be used for wood screws, machine bolts or lag bolts. One such driver known in the art is a push-type spiral ratchet screwdriver or otherwise known as Yankee screwdriver. The function of the Yankee screwdriver is to provide torque to a screwdriver bit with axial movement of its handle. The up and down motion of the handle is converted to the rotary motion of the screwdriver bit using a driver mechanism that is used to fasten/unfasten a screw.

But the Yankee screwdriver also has disadvantages. The Yankee screwdriver has a spindle that is required to be held by a hand of the user while the other hand pushes/pulls the handle grip. This causes the respective wrists of the user to be in an uncomfortable position and causes inconvenience to the user. This inconvenience significantly increases when the user has to perform the fastening operation repeatedly for a predetermined duration. Prolonged usage causes pain in the user's fingers of the hand holding the spindle. Moreover, only a limited torque may be generated using a Yankee screwdriver. High torque applications require more force to be applied by the user which is not feasible for a user who performs such operations for long durations.

Therefore, there remains a need in the art for a spiral ratchet driver with a crank and slider mechanism which does not suffer from above mentioned deficiencies and provides a cost-effective solution to the above mentioned problems.

Any discussion of the background art throughout the specification should in no way be considered as an admission that such background art is prior art nor that such background art is widely known or forms part of the common general knowledge in the field.

SUMMARY OF THE INVENTION

The present invention is described hereinafter by various embodiments. This invention may, however, be embodied in many different forms and should not be construed as limited to the embodiment set forth herein. Rather, the embodiment is provided so that this disclosure will be thorough and complete and will fully convey the scope of the invention to those skilled in the art.

Embodiments of the present invention aim to provide a spiral ratchet driver with a crank and slider mechanism. According to a first aspect of the present invention, the spiral ratchet driver with crank and slider mechanism comprises a spiral ratchet driver having a shank housing, a journal having a hole, connected to the shank housing by means of a screw at the top of the shank housing, wherein the journal is configured to cover an upper portion of the shank housing, a ratchet mechanism assembly connected adjacent to the journal covering a lower portion of the shank housing, a shank having a first end, a second end and spiral flutes, received in the shank housing and the ratchet mechanism assembly, the shank being configured to slide within the shank housing and the ratchet mechanism assembly and the ratchet mechanism assembly being configured to rotate the shank when it is pushed towards a spindle, a spindle bearing connecting the second end of the shank to a chuck or a square drive, the spindle bearing transferring the rotary motion of the shank to the connected chuck or the square drive and the chuck being configured to receive a bit and transmit the rotary motion of the shank to the bit, and the square drive being configured to receive a socket and transmit the rotary motion of the shank to the socket, a lever connecting bar connected to the hole of the journal by means of a first rivet, a lever having a lever handle cushion grip, rotatably connected with the lever connecting bar by means of a second rivet, a handle bar having a free end, a fixed end and a handle bar grip on the free end, the handle bar being connected with the lever by means of a third rivet near the free end and connected with the spindle at the fixed end, a journal housing attached with the journal and connected with the handle bar by means of set screws and four or more bearing slides disposed between the journal and the journal housing. Further, the lever is configured to rotate about the second rivet and the third rivet between a top position and a bottom position. Additionally, the journal housing is configured to enable the journal and the shank housing to move within the journal housing when the lever is rotated between the top position and the bottom position and the four or more bearing slides are configured to prevent the rotation of the journal and the shank housing during the motion of the journal and the shank housing within the journal housing.

In accordance with an embodiment of the present invention, the ratchet mechanism assembly is further configured to prevent rotation of the shank while the lever is being rotated from the bottom position to the top position.

In accordance with an embodiment of the present invention, the spindle bearing is connected to a chuck to receive the bit for low torque requirement.

In accordance with an embodiment of the present invention, the spindle bearing is connected to the square drive to receive the socket for high torque requirement.

In accordance with an embodiment of the present invention, the four or more bearing slides are low friction bearings.

In accordance with an embodiment of the present invention, the lever and the handle bar are made of a material selected from a group of metals and alloys.

In accordance with an embodiment of the present invention, the handle bar grip and the lever handle cushion grip are made of a material selected from one of a plastic, a rubber or a foam.

According to a second aspect of the present invention, a spiral ratchet driver with crank and slider mechanism comprises a spiral ratchet driver having a shank housing with a second hole, a ratchet mechanism assembly connected to the shank housing and covering a lower portion of the shank housing, a shank having a first end, a second end and spiral flutes, received in the shank housing and the ratchet mechanism assembly, the shank being configured to slide within the shank housing and the ratchet mechanism assembly and the ratchet mechanism assembly being configured to rotate the shank when it is pushed towards a spindle, a spindle bearing connecting the second end of the shank to a chuck or a square drive, the spindle bearing transferring the rotary motion of the shank to the connected chuck or a square drive and the chuck being configured to receive a bit and transmit the rotary motion of the shank to the bit, and the square drive being configured to receive a socket and transmit the rotary motion of the shank to the socket, a lever connecting bar connected to the second hole of the shank housing by means of a first rivet, a lever having a lever handle cushion grip, rotatably connected with the lever connecting bar by means of a second rivet, a handle bar having a free end, a fixed end and a handle bar grip on the free end, the handle bar being connected with the lever by means of a third rivet near the free end and connected with the spindle at the fixed end, a journal housing attached with the shank housing and connected with the handle bar by means of set screws and four or more bearing slides disposed between the shank housing and the journal housing. Further, the lever is configured to rotate about the second rivet and the third rivet between a top position and a bottom position. Additionally, the journal housing is configured to enable the shank housing to move within the journal housing when the lever is rotated between the top position and the bottom position. Moreover, the four or more bearing slides are configured to prevent the rotation of the shank housing during the motion of the shank housing within the journal housing.

In accordance with an embodiment of the present invention, the ratchet mechanism assembly is further configured to prevent rotation of the shank while the lever is being rotated from the bottom position to the top position.

In accordance with an embodiment of the present invention, the spindle bearing is connected to a chuck to receive the bit for low torque requirement.

In accordance with an embodiment of the present invention, the spindle bearing is connected to the square drive to receive the socket for high torque requirement.

In accordance with an embodiment of the present invention, the four or more bearing slides are low friction bearings.

In accordance with an embodiment of the present invention, the lever and the handle bar are made of a material selected from a group of metals and alloys.

In accordance with an embodiment of the present invention, the handle bar grip and the lever handle cushion grip are made of a material selected from one of a plastic, a rubber or a foam.

BRIEF DESCRIPTION OF THE DRAWINGS

So that the manner in which the above recited features of the present invention can be understood in detail, a more particular description of the invention, briefly summarized above, may have been referred by examples, some of which are illustrated in the appended drawings. It is to be noted, however, that the appended drawings illustrate only typical examples of this invention and are therefore not to be considered limiting of its scope, for the invention may admit to other equally effective examples.

These and other features, benefits, and advantages of the present invention will become apparent by reference to the following text figure, with like reference numbers referring to like structures across the views, wherein.

DETAILED DESCRIPTION OF THE EMBODIMENTS

Figure 1A:
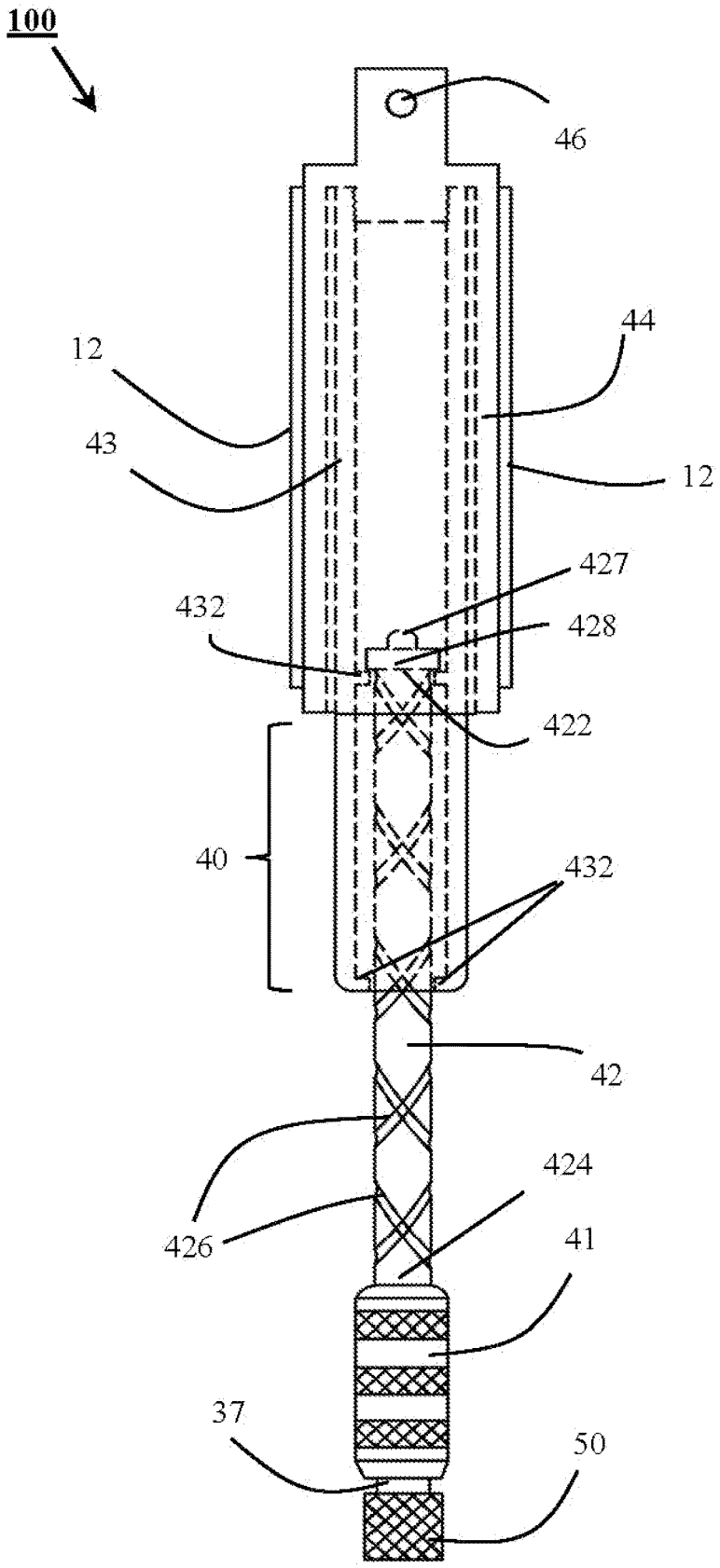
FIG. 1A illustrates a spiral ratchet driver, in accordance with an embodiment of the present invention.

Detailed embodiments of the present disclosure are described herein; however, it is to be understood that disclosed embodiments are merely exemplary of the present disclosure, which may be embodied in various alternative forms. Specific process details disclosed herein are not to be interpreted as limiting, but merely as a representative basis for teaching one skilled in the art to variously employ the present disclosure in any appropriate process.

The terms used herein are for the purpose of describing exemplary embodiments only and are not intended to be limiting. As used herein, the singular forms "a," "an," and "the" are intended to include the plural forms as well, unless the context clearly indicates otherwise. It will be further understood that the terms "comprises" or "comprising," when used in this specification, do not preclude the presence or addition of one or more components, steps, operations, and/or elements other than a mentioned component, step, operation, and/or element.

The present invention aims to provide a spiral ratchet driver with a crank and slider mechanism using a lever and a handle bar. The driver design may be for both high torque and low torque applications by using either a chuck (for driver bits) or a square drive (for sockets). The spiral ratchet driver is envisaged to include components like a shank housing, a shank having spiral flutes, a ratchet mechanism assembly, spindle, chuck etc. The present invention achieves the above mentioned objective using a specially designed journal that covers the shank housing of the spiral ratchet driver, similar to the handle of a typical screw driver. The journal may be attached with the shank housing using a connection means such as a screw. Additionally, the journal has a hole on the top that allows it to be connected with the lever using a lever connecting bar and a rivet. The journal is in turn housed in a journal housing that allows the journal to move up and down. Low friction bearings are embedded around the journal and engage slots in the journal housing to prevent any rotation of the journal during up and down movement.

The lever is in turn connected with a handle bar using another rivet. The handle bar is kept stationery by connecting the lower end of the handle bar to a spindle. One end of the journal housing is connected to the handle bar. The user may then hold the handle bar using one hand and rotate the lever using the other hand. The lever rotates about the rivets used to connect the lever with the handle bar and the lever connecting bar. The rotation of the lever causes the journal, the connected shank housing and the ratchet mechanism assembly to move up and down in a linear motion. The ratchet mechanism assembly in the lower portion of the shank housing is configured to convert its downward motion into a rotary motion of the shank (this will be discussed in more detail in the following sections). It should be noted that the lever and the handle bar keep the user's wrist in a more neutral position as well and enable the user to generate more torque with less force application.

The embodiments of the present disclosure will now be described more fully hereinafter with reference to the accompanying drawings, which form a part hereof, and which show, by way of illustration, specific example embodiments. The following detailed description is not intended to be taken in a limiting sense.

FIG. 1A illustrates a spiral ratchet driver 100, in accordance with an embodiment of the present invention. As shown in FIG. 1A, the spiral ratchet driver 100 is in an extended position. The spiral ratchet driver 100 comprises a shank housing 43 (shown in hidden lines). The shank housing 43 may be an open-ended cylindrical body made of a material such as, but not limited to, a metal or an alloy like steel etc. The shank housing 43 has an upper portion and a lower portion. Additionally, the shank housing 43 includes two cylindrical shank guides 432 in the internal periphery of the lower portion. Further, a ratchet mechanism assembly 40 resides in the lower portion of the shank housing 43 and is constrained between the two shank guides. This ratchet mechanism assembly 40 is envisaged to confine components such as an outer cover, a switch 31 (FIG. 2A), two pivoting pawls (not shown) and two ratchet wheel drive screws (not shown). The ratchet wheel drive screw is a cylinder with an internal spiral spline and an external ratchet wheel. One drive screw has a clockwise spline and the other has an anticlockwise spline.

Also included in the spiral ratchet driver 100 is a shank 42 having a first end 422 and a second end 424. The shank 42 is made of a material such as, but not limited to, steel. The shank 42 is a solid cylindrical body and has spiral flutes/grooves 426 on its surface. Both clockwise and anticlockwise spiral flutes exist and engage with the splines of the ratchet wheel drive screws. When the shank housing 43 is pushed down, the confined ratchet wheel drive screws will also be pushed down and depending on which drive screw is selected by the switch will then rotate the shank because the drive screw's ratchet wheel is locked by its corresponding pawl. The shank 42 will rotate clockwise or anticlockwise depending on which ratchet wheel drive screw is selected by the switch. In addition, the ratchet wheel's teeth are designed so that locking will only occur on the downstroke. The ratchet wheel drive screw is free to rotate during an upstroke because there is no locking engagement with the pawl and as a result the shank 42 cannot rotate. On an upstroke the familiar clicking noise will be heard as the ratchet wheel teeth spin past the pawl. The shank 42 also has a shank screw 427 connected at the first end. In one embodiment, the shank screw 427 and the shank 42 may be manufactured as an integral component by machining. The shank nut 428 is fastened onto the shank screw 427. The shank nut 428 and the shank guides 432 ensure that the shank 42 slides properly within the shank housing 43. In addition, the shank nut 428 will stop the shank housing 43 to mark the end of the upstroke.

Figure 1B:
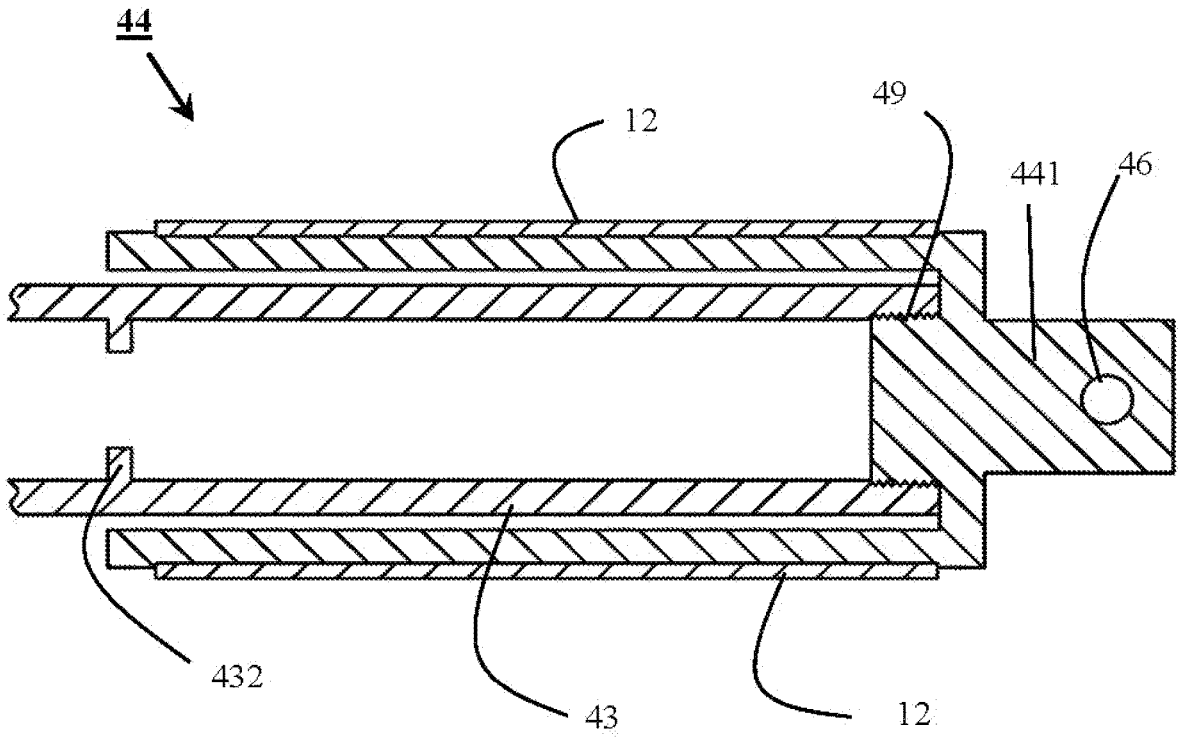
FIG. 1B illustrates the sectional view of a journal of the spiral ratchet driver, in accordance with an embodiment of the present invention.

Furthermore, the spiral ratchet driver 100 comprises a journal 44 connected to the shank housing 43. The shank housing 43 may be connected with the journal 44 by a connection means such as a screw 49. The journal 44 may be, but not limited to, a hollow cylindrical body having a protrusion 441 at the top. The journal 44 is configured to cover the shank housing 43. The journal 44 may have a predetermined external diameter, say, 1 inch and a predetermined length in the range of 3-4 inches. Additionally, four or more bearing slides 12 are provided on the outer surface of the journal 44. The bearing slides 12 may be attached to outer surface of the journal 44 by means of, but not limited to, an adhesive. The four or more bearing slides 12 may be, but not limited to, low-friction bearings such as Teflon bearings. In addition, the journal 44 includes a hole 46 provided on the protrusion 441. The hole 46 is capable of receiving a connection means such as a rivet. The same has been illustrated in FIG. 1B.

Figure 1C:
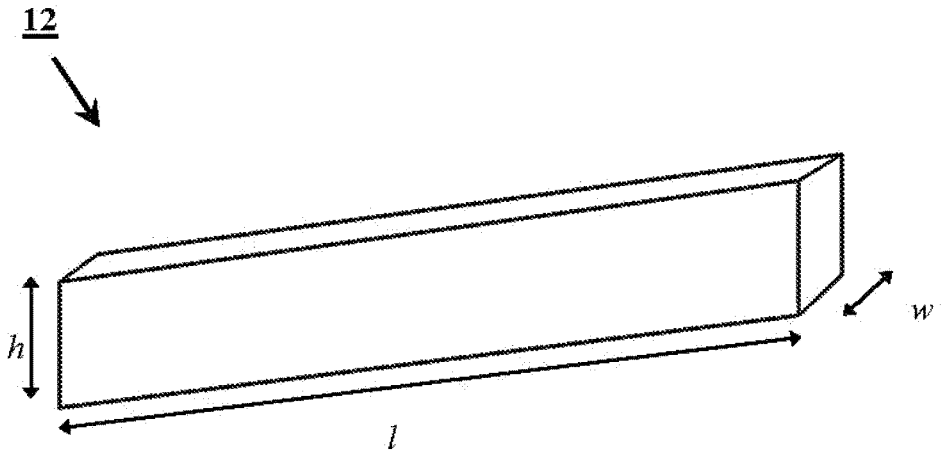
FIG. 1C illustrates a bearing slide of the spiral ratchet driver, in accordance with an embodiment of the present invention.

FIG. 1C illustrates a bearing slide of the 12, in accordance with an embodiment of the present invention. As shown in FIG. 1C, the shape of the bearing slide may be similar to, but not limited to, a cuboid having a predetermined length 'l', predetermined width 'w' and predetermined height 'h'. For example: 'l' may be around 2.7 inches, 'w' may be around 0.125 inch and 'h' may be around 0.19 inch. However, a skilled addressee would appreciate that additional components, other than those mentioned above and/or shown in the figures, may also be included in the spiral ratchet driver 100 without departing from the scope of the present invention.

Figure 1D:
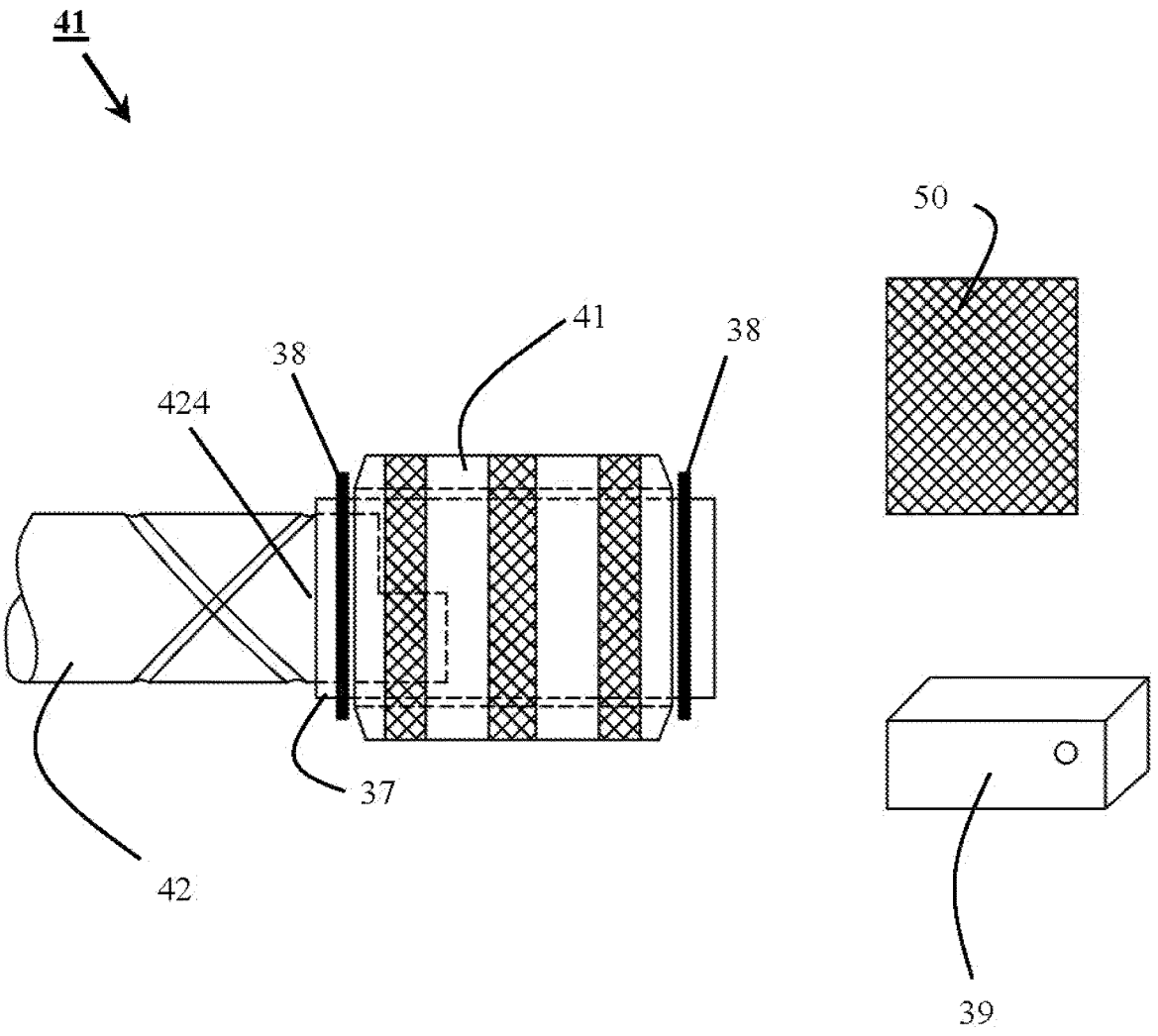
FIG. 1D illustrates a spindle having spindle bearing and retaining rings, in accordance with an embodiment of the present invention.

Also included in the spiral ratchet driver 100, is a spindle 41 and its corresponding spindle bearing 37 as shown in FIG. 1D. Note that only FIG. 1D shows the details of the spindle 41 in this document. The second end 424 of the shank 42 is inserted into a hole in the spindle bearing 37 and permanently secured by way of a pin (not shown). The spindle 41 has an inner diameter that is slightly larger than the outer diameter of the spindle bearing 37 and is secured in place by the two retaining rings 38. Thus, with the spindle 41 held securely, the spindle bearing 37 and shank 42 are free to rotate. Depending on a low torque or high torque application, the end of the spindle bearing 37 is attached to either a chuck 50 (for hex bits) or to a square drive 39 (for sockets). The shank 42 transmits a rotary motion to the spindle bearing 37 which in turn transmits a rotary motion to either the chuck 50 or the square drive 39. The chuck 50 or the square drive 39 then will transmit a rotary motion to a hex bit or a socket similar to a socket wrench. Typical material for the low torque spindle bearing and chuck 50 is bronze. For the high torque bearing and square drive 39, forged steel could be used. The spindle bearing 37 and chuck 50 or square drive 39 would typically be fabricated as one piece but for this embodiment they are referenced as separate pieces. Note that for the assembly drawings in this document the chuck 50 is shown and not the square drive 39.

Figure 2A:
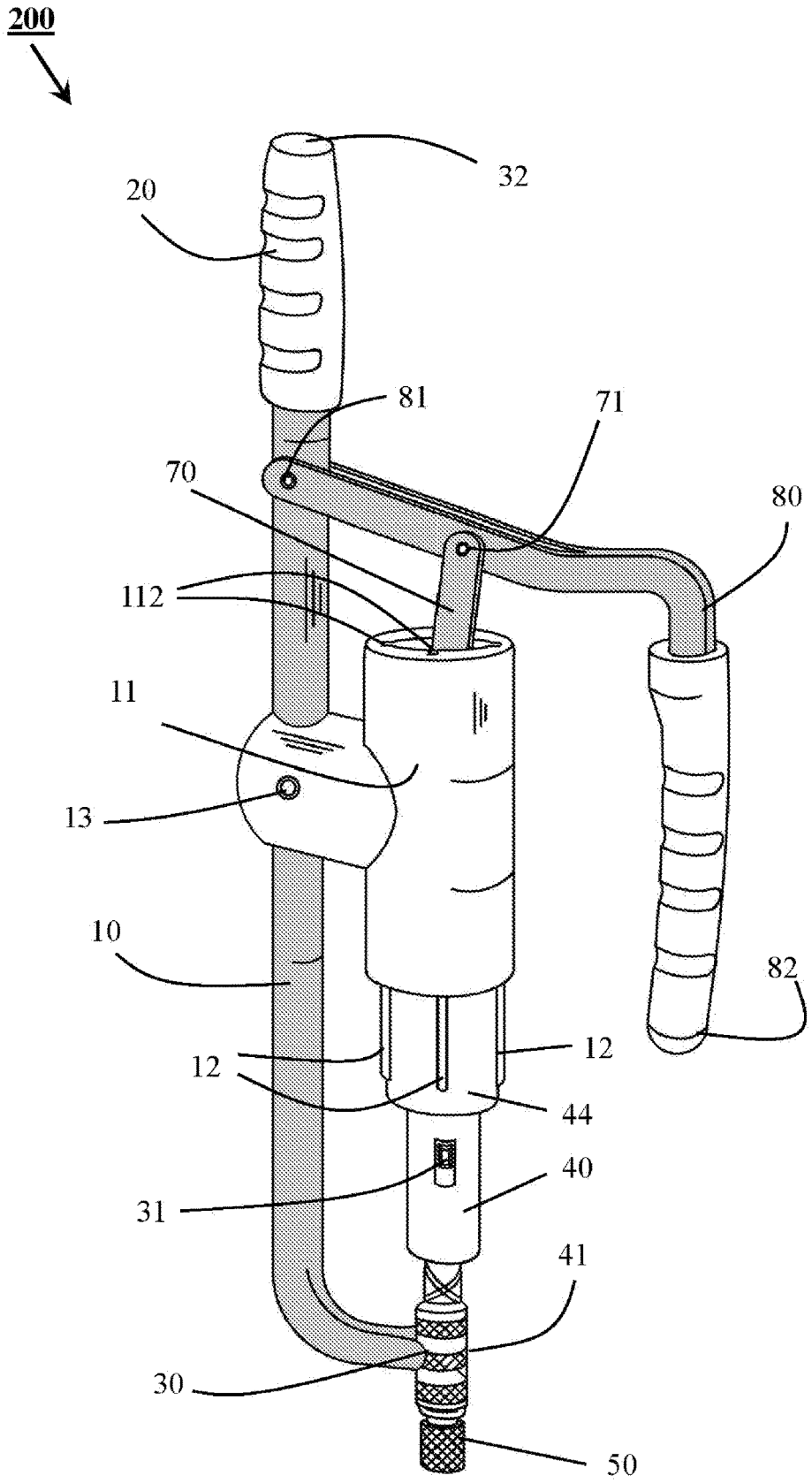
FIG. 2A illustrates the spiral ratchet driver with a crank and slider mechanism, in accordance with an embodiment of the present invention.
Figure 2B:
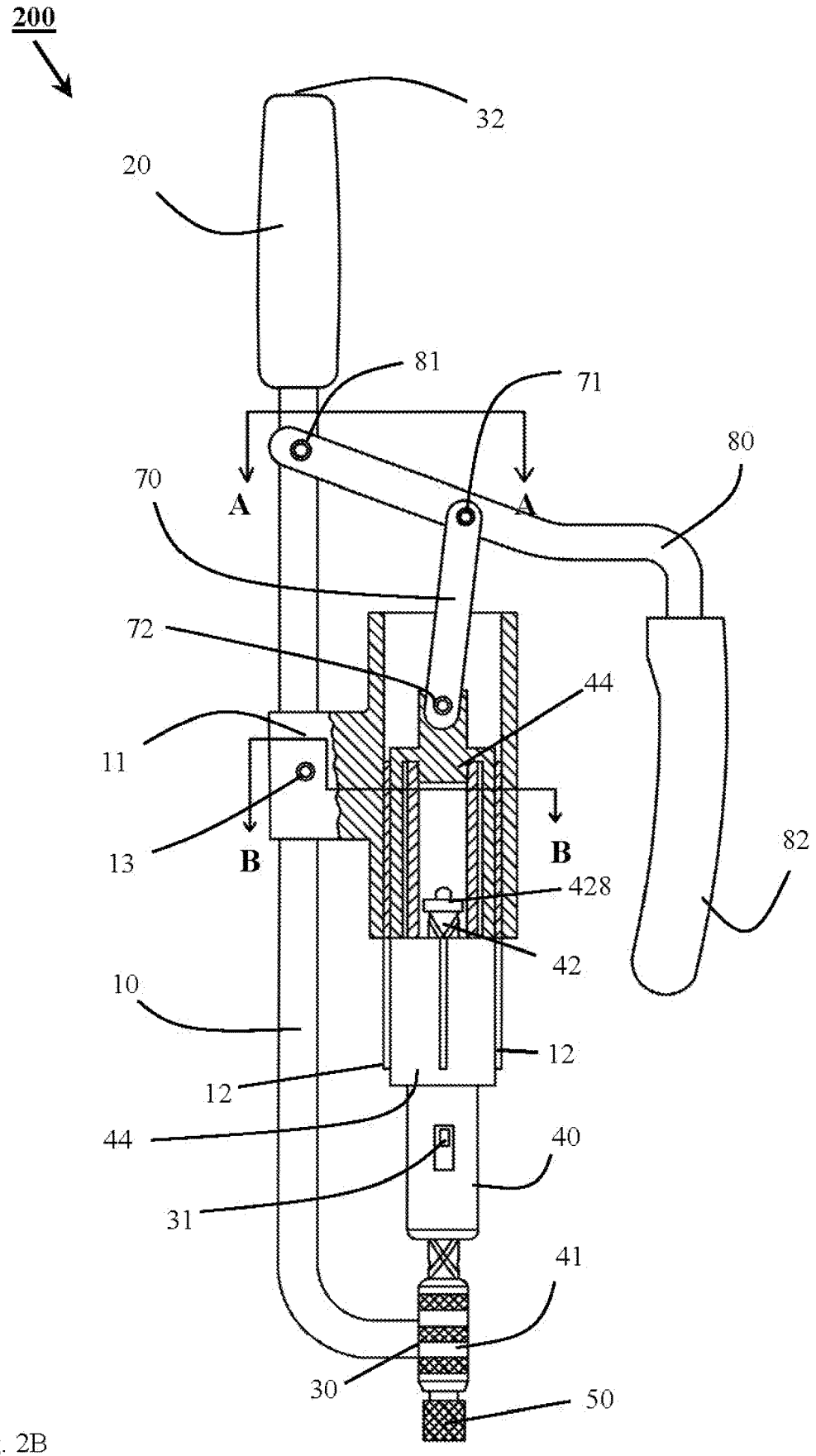
FIG. 2B illustrate a sectional view of the spiral ratchet driver with a crank and slider mechanism, in accordance with an embodiment of the present invention.

FIG. 2A illustrates the spiral ratchet driver with a crank and slider mechanism 200, in accordance with an embodiment of the present invention. Also, FIG. 2B illustrates a sectional view of the spiral ratchet driver with a crank and slider mechanism 200, in accordance with an embodiment of the present invention. The provision of the crank and slider mechanism along with the spiral ratchet driver provides a mechanical advantage of generating more force and torque with less force application. As shown in FIGS. 2A and 2B, a lever connecting bar 70 is connected to the hole 46 of the journal 44 by means of a first rivet 72. Further, a lever 80 having a lever handle cushion grip 82 is rotatably connected with the lever connecting bar 70 by means of a second rivet 71. The rivets are used because they allow rotation of the connected components while keeping them securely connected at the same time. The lever 80 may have one or more bends. Also, a handle bar 10 having a free end 32 and fixed end 30 is provided. A handle bar grip 20 is provided at the free end 32. The handle bar grip 20 may approximately be the size of a medium sized screwdriver handle. The handle bar 10 may be curved near the fixed end 31. The handle bar 10 may have a profile similar to, but not limited to, J-shape or an L-shape.

The handle bar 10 is connected with the lever 80 by means of a third rivet 81 below the handle bar grip 20. The same has been illustrated more clearly in section A-A shown in FIG. 2C. The orthogonal distance between the third rivet 81 and the chuck 50 may be in the range of 10.25-10.75 inches. Further, the fixed end 30 of the handle bar 10 is connected with the spindle 41. This makes the handle bar 10 stationary. The connection may be achieved by means of, but not limited to, a welding process. In other words, the fixed end 30 may be welded to the spindle 41. In one embodiment, the fixed end 30 may include a circular hole that receives as well as holds the spindle 41 in place. In addition, the handle bar 10 is connected with a journal housing 11 by means of 2 set screws 13 and therefore the handle bar 10 keeps the journal housing 11 stationary as well. The orthogonal distance between the set screws 13 and the chuck 50 may be in the range of 7 to 7.5 inches.

Figure 2C:
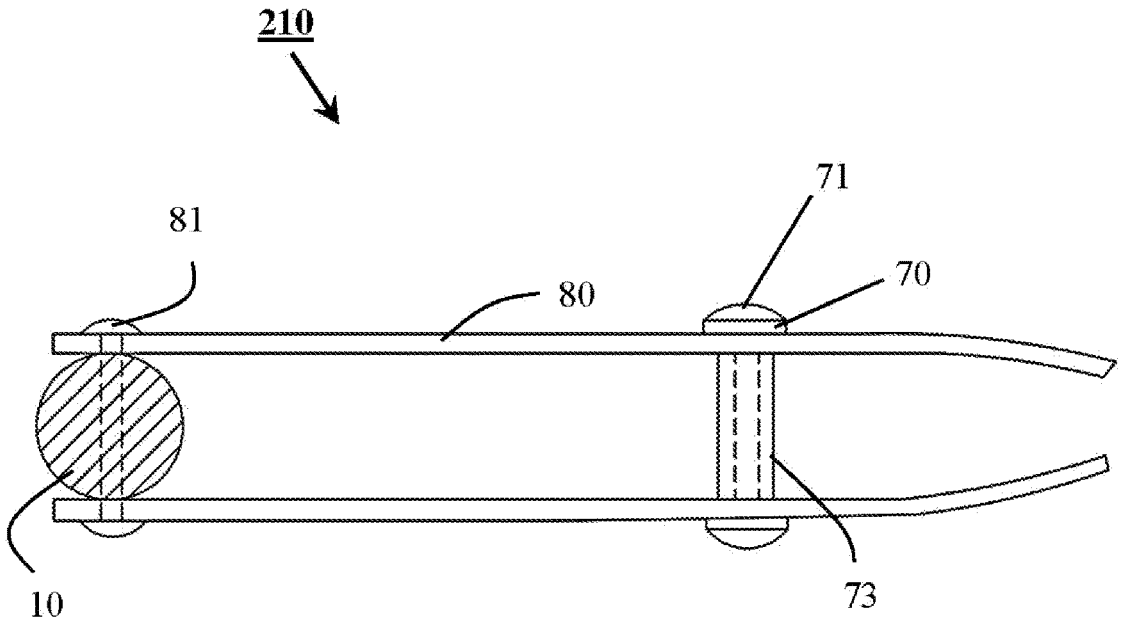
FIG. 2C illustrates a section A-A of FIG. 2B, in accordance with an embodiment of the present invention.
Figure 2D:
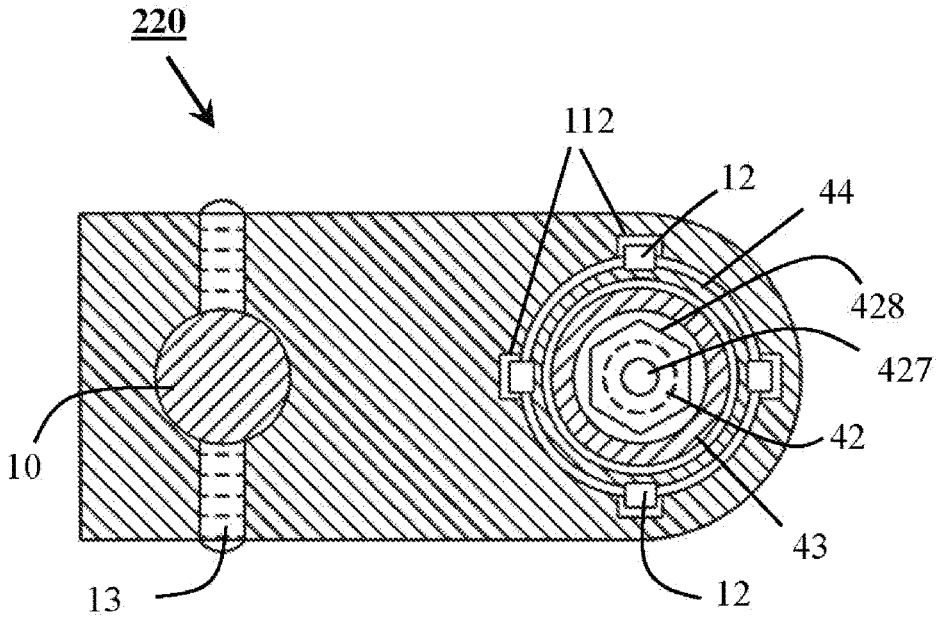
FIG. 2D illustrates a section B-B of FIG. 2B, in accordance with another embodiment of the present invention.

The journal housing 11 is configured to cover the journal 44. The journal housing 11 includes four or more broached slots 112 on an internal periphery of the journal 44. The four or more broached slots 112 are adapted to receive the respective four or more bearing slides 12. In other words, the bearing slides 12 are sandwiched between the journal 44 and the journal housing 11 and engaged in the broached slots 112. For example: Four broached slots may be provided diametrically around the internal periphery of the journal housing 11, each placed 90 degrees apart from the adjacent broached slot and 4 bearing slides provided on the outer surface of the journal 44 may be received in the four or more broached slots respectively. The four or more broached slots 112 allow a linear motion of the four or more bearing slides 12 while preventing any rotation of the journal 44 during the linear motion. The same has been illustrated more clearly in section B-B shown in FIG. 2D. Also shown in FIG. 2C is the handle bar 10 sandwiched between the arms of the lever 80. Additionally, the journal housing 11 may have a predetermined length in the range of, but not limited to, 3 to 3.5 inches.

The journal housing 11 is configured to allow the journal 44 to move up and down within the journal housing 11 when the lever 80 is rotated in a clockwise or an anti-clockwise direction. And the four or more bearing slides 12 engaged in the respective four or more broached slots 112 ensure that the journal 44 does not rotate during the movement of the journal 44 within the journal housing 11. The lever 80 is configured to rotate about the second rivet 71 and the third rivet 81. The top position for the lever may be achieved by an anti-clockwise rotation and the bottom position may be achieved by a clockwise rotation. The range of rotation of the lever 80 may be, but not limited to, 90 degrees. Additionally, the lever 80 and the handle bar 10 are made of a material selected from a group comprising, but not limited to, metals and alloys. As the handle bar grip 20 and the lever handle cushion grip 82 are adapted to be held by the hands of the user, therefore, the handle bar grip 20 and the lever handle cushion grip 82 are made of a softer material selected from one of, but not limited to, a plastic, a rubber or a foam.

In one embodiment of the present invention, instead of the journal 44, the shank housing 43 may be provided with a second protrusion at the top having a second hole. The second hole is adapted to connect the shank housing 43 to the lever connecting bar 70 by means of the first rivet 72. The four or more bearing slides 12 may be provided on the outer surface of the shank housing 43 to be received in the four or more broached slots 112 provided on the internal periphery of the journal housing 11. The rest of the connections can remain the same as described in previous figures. In such an arrangement, the requirement of the journal 44 may be eliminated completely, thereby, reducing the number of components involved and resulting in a simpler assembly.

Figure 3A:
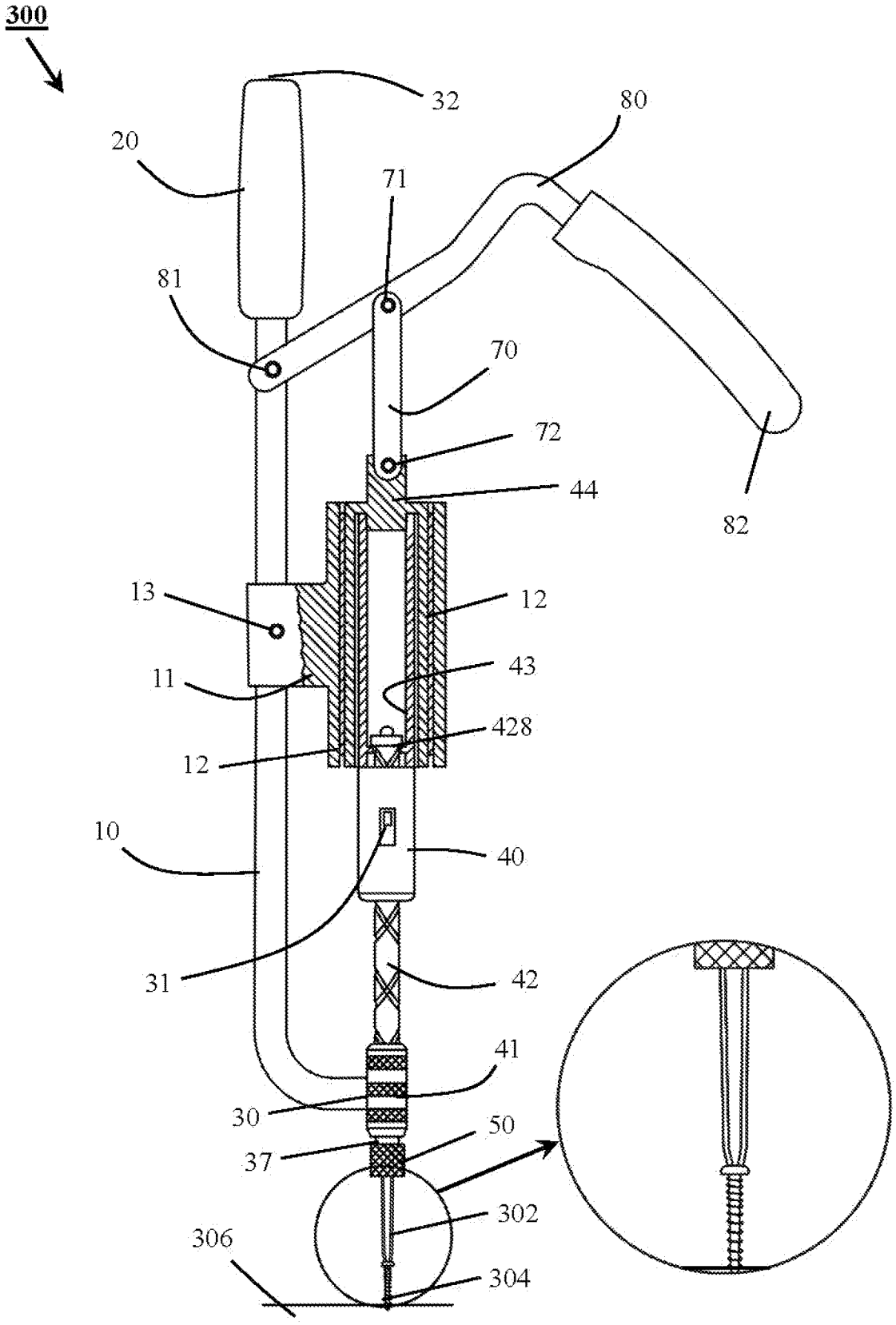
FIG. 3A-3B illustrate an implementation of the spiral ratchet driver with the crank and slider mechanism, in accordance with an embodiment of the present invention.
Figure 3B:
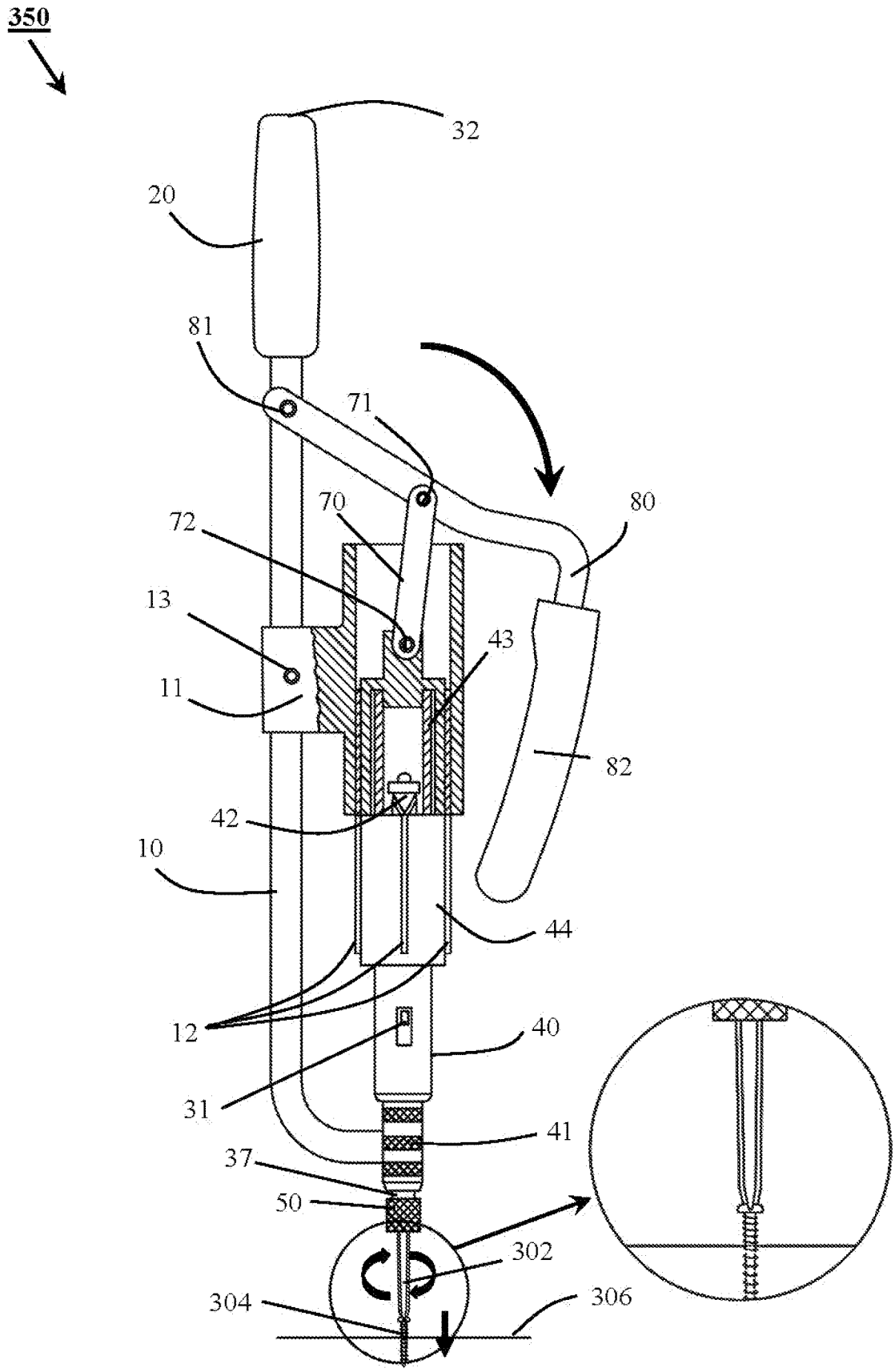

FIG. 3A-3B illustrate an implementation of the spiral ratchet driver 100 with the crank and slider mechanism 200, in accordance with an embodiment of the present invention. The spiral ratchet driver 100 with the crank and slider mechanism 200 may be configured for a low torque or the high torque application. For a low torque operation, a hex bit may be received in the chuck 50 and for a high torque operation, the square drive with a corresponding socket would be used. As an example, it is envisaged that a screwdriver bit 302 is received in the chuck 50. Then, the switch 31 of the ratchet mechanism assembly 40 is enabled to rotate the shank 42 in the clockwise direction to fasten the screw 304. A user may hold the handle bar grip 20 with one hand and the lever handle cushion grip 82 with the other hand. After that the screwdriver bit 302 is engaged with the screw 304 that is required to be fastened on a work piece 306. As shown in FIG. 3A, the lever 80 of the spiral ratchet driver 100 with the crank and slider mechanism 20 is in a top position.

FIG. 3B illustrates the lever 80 of the spiral ratchet driver with a crank and slider mechanism 200 in a bottom position. After successfully engaging the screwdriver bit 302 with the screw 304, the lever 80 is rotated downwards (clockwise) to the bottom position, to provide downward motion to the journal 44 and the shank housing 43, which causes the ratchet mechanism assembly 40 (with its locked ratchet) to move down. The ratchet mechanism assembly 40 then causes the shank 42 to rotate in a clockwise direction. The shank 42 causes the chuck 50 and thereby the screwdriver bit 302 to rotate in the clockwise direction and fasten the screw 304 in the work piece 306. The same has been illustrated in FIG. 3B. If the screw 302 isn't completely fastened in a single downward rotational stroke then the lever 80 may be pulled up to the top position again, and additional downward rotational strokes may be provided till the screw 304 is fastened completely. The ratchet mechanism assembly 40 prevents any reverse rotation of the shank 42 while the lever 80 is pulled upwards. This completes the fastening operation.

The present invention offers a number of advantages. Firstly, it provides a cost effective solution to the problems of prior art and at the same time is capable of producing higher torque. The crank and slider mechanism enables the user to generate more torque with less force application thereby providing a mechanical advantage. Secondly, using a lever and the handle bar keeps the user's wrist in a more neutral position and prevents any inconvenience even after repetitive operations. In addition, compared to common tool such as the T-handle Allen wrench, this invention can provide a more wrist-friendly alternative. Further, the shank diameter may be increased by two to three times for generating even higher torque depending upon the high torque application to be performed.

The terms and descriptions used herein are set forth by way of illustration only and are not meant as limitations. Examples and limitations disclosed herein are intended to be not limiting in any manner, and modifications may be made without departing from the spirit of the present disclosure.

Those skilled in the art will recognize that many variations are possible within the spirit and scope of the disclosure, and their equivalents, in which all terms are to be understood in their broadest possible sense unless otherwise indicated.

Various modifications to these embodiments are apparent to those skilled in the art from the description and the accompanying drawings. The principles associated with the various embodiments described herein may be applied to other embodiments. Therefore, the description is not intended to be limited to the embodiments shown along with the accompanying drawings but is to be providing the broadest scope consistent with the principles and the novel and inventive features disclosed or suggested herein. Accordingly, the disclosure is anticipated to hold on to all other such alternatives, modifications, and variations that fall within the scope of the present disclosure and appended claims.

The invention claimed is:

1. A spiral ratchet driver with crank and slider mechanism comprising:

a spiral ratchet driver having:

a shank housing;

a journal having a hole, connected to the shank housing by means of a screw at the top of the shank housing, wherein the journal is configured to cover an upper portion of the shank housing;

a ratchet mechanism assembly connected adjacent to the journal covering a lower portion of the shank housing;

a shank having a first end, a second end and spiral flutes, received in the shank housing and the ratchet mechanism assembly, the shank being configured to slide within the shank housing and the ratchet mechanism assembly and the ratchet mechanism assembly being configured to rotate the shank during the sliding motion of the ratchet mechanism assembly;

a spindle having a spindle bearing connecting the second end of the shank to a chuck or a square drive, the spindle being configured to transfer the rotary motion of the shank to the connected chuck or the square drive and the chuck being configured to receive a bit and transmit the rotary motion of the shank to the bit and the square drive being configured to receive a socket and transmit the rotary motion of the shank to the socket;

a lever connecting bar connected to the hole of the journal by means of a first rivet;

a lever having a lever handle cushion grip, rotatably connected with the lever connecting bar by means of a second rivet;

a handle bar having a free end, a fixed end and a handle bar grip on the free end, the handle bar being connected with the lever by means of a third rivet near the free end and connected with the spindle from the fixed end;

a journal housing attached with the journal and connected with the handle bar by means of a set screw; and four or more bearing slides disposed between the journal and the journal housing;

wherein the lever is configured to rotate about the second rivet and the third rivet between a top position and a bottom position;

wherein the journal housing is configured to enable the journal and the shank housing to move within the journal housing when the lever is rotated between the top position and the bottom position; and wherein the four or more bearing slides are configured to prevent the rotation of the journal and the shank housing during the motion of the journal and the shank housing within the journal housing.

2. The spiral ratchet driver with crank and slider mechanism as claimed in claim 1, wherein the ratchet mechanism assembly is further configured to prevent rotation of the shank while the lever is being rotated from the bottom position to the top position.

3. The spiral ratchet driver with crank and slider mechanism as claimed in claim 1, wherein the bit to be received in the chuck is a hex bit for low torque requirement.

4. The spiral ratchet driver with crank and slider mechanism as claimed in claim 1, wherein the square drive is configured to receive a socket for high torque requirement.

5. The spiral ratchet driver with crank and slider mechanism as claimed in claim 1, wherein the four or more bearing slides are low friction bearings.

6. The spiral ratchet driver with crank and slider mechanism as claimed in claim 1, wherein the lever and the handle bar are made of a material selected from a group of metals and alloys.

7. The spiral ratchet driver with crank and slider mechanism as claimed in claim 1, wherein the handle bar grip and the lever handle cushion grip are made of a material selected from one of a plastic, a rubber or a foam.

8. A spiral ratchet driver with crank and slider mechanism comprising:

a spiral ratchet driver having:

a shank housing with a second hole;

a ratchet mechanism assembly connected to the shank housing and covering a lower portion of the shank housing;

a shank having a first end, a second end and spiral flutes, received in the shank housing and the ratchet mechanism assembly, the shank being configured to slide within the shank housing and the ratchet mechanism assembly and the ratchet mechanism assembly being configured to rotate the shank during the sliding motion of the ratchet mechanism assembly;

a spindle having a spindle bearing connecting the second end of the shank to a chuck or a square drive, the spindle being configured to transfer the rotary motion of the shank to the connected chuck or a square drive and the chuck being configured to receive a bit and transmit the rotary motion of the shank to the bit and the square drive being configured to receive a socket and transmit the rotary motion of the shank to the socket;

a lever connecting bar connected to the second hole of the shank housing by means of a first rivet;

a lever having a lever handle cushion grip, rotatably connected with the lever connecting bar by means of a second rivet;

a handle bar having a free end, a fixed end and a handle bar grip on the free end, the handle bar being connected with the lever by means of a third rivet near the free end and connected with the spindle from the fixed end;

a journal housing attached with the shank housing and connected with the handle bar by means of a set screw; and four or more bearing slides disposed between the shank housing and the journal housing;

wherein the lever is configured to rotate about the second rivet and the third rivet between a top position and a bottom position;

wherein the journal housing is configured to enable the shank housing to move within the journal housing when the lever is rotated between the top position and the bottom position; and wherein the four or more bearing slides are configured to prevent the rotation of the shank housing during the motion of the shank housing within the journal housing.

9. The spiral ratchet driver with crank and slider mechanism as claimed in claim 8, wherein the ratchet mechanism assembly is further configured to prevent rotation of the shank while the lever is being rotated from the bottom position to the top position.

10. The spiral ratchet driver with crank and slider mechanism as claimed in claim 8, wherein the bit to be received in the chuck is a hex bit for low torque requirement.

11. The spiral ratchet driver with crank and slider mechanism as claimed in claim 8, wherein the square drive is configured to receive a socket for high torque requirement.

12. The spiral ratchet driver with crank and slider mechanism as claimed in claim 8, wherein the four or more bearing slides are low friction bearings.

13. The spiral ratchet driver with crank and slider mechanism as claimed in claim 8, wherein the lever and the handle bar are made of a material selected from a group of metals and alloys.

14. The spiral ratchet driver with crank and slider mechanism as claimed in claim 8, wherein the handle bar grip and the lever handle cushion grip are made of a material selected from one of a plastic, a rubber or a foam.

* * * * *